US009790718B2

(12) United States Patent
Armstrong

(10) Patent No.: US 9,790,718 B2
(45) Date of Patent: Oct. 17, 2017

(54) DOOR HINGE

(71) Applicant: Blades Joinery Limited, Marden, Kent (GB)

(72) Inventor: Shane Armstrong, Crowborough (GB)

(73) Assignee: DIAB DESIGN LIMITED, Surrey (GB)

( * ) Notice: Subject to any disclaimer, the term of this patent is extended or adjusted under 35 U.S.C. 154(b) by 0 days.

(21) Appl. No.: 14/417,195

(22) PCT Filed: Jul. 24, 2013

(86) PCT No.: PCT/GB2013/000323

§ 371 (c)(1),
(2) Date: Jan. 26, 2015

(87) PCT Pub. No.: WO2014/016545

PCT Pub. Date: Jan. 30, 2014

(65) Prior Publication Data

US 2015/0167366 A1 Jun. 18, 2015

(51) Int. Cl.
*E05D 3/14* (2006.01)
*E05D 15/00* (2006.01)

(52) U.S. Cl.
CPC ..... *E05D 3/14* (2013.01); *E05D 3/142* (2013.01); *E05D 15/00* (2013.01); *Y10T 16/52* (2015.01); *Y10T 16/547* (2015.01); *Y10T 16/5476* (2015.01)

(58) Field of Classification Search
CPC ... Y10T 16/5476; Y10T 16/52; Y10T 16/547; Y10T 16/5525; Y10T 16/5443; Y10T 16/53833; E05D 3/14; E05D 15/00; E05D 3/142
USPC ..... 16/370, 379, 358, 366, 221, 288; 49/398
See application file for complete search history.

(56) References Cited

U.S. PATENT DOCUMENTS 1,078,786 A 11/1913 Hanba et al.
1,484,093 A * 2/1924 Soss ..... E05D 3/186 16/358
1,688,996 A * 10/1928 Soss ..... E05D 3/186 16/358
1,925,209 A * 9/1933 Schwartz ..... E05D 3/18 16/358
2,121,790 A 6/1938 Etzel
2,164,757 A * 7/1939 Soss ..... E05D 3/147 16/370
2,206,708 A * 7/1940 Stumpf ..... E05D 3/06 16/358

(Continued)

FOREIGN PATENT DOCUMENTS

CN 1906372 A 1/2007
CN 201318087 Y 9/2009

(Continued)

OTHER PUBLICATIONS

International Search Report for corresponding Patent Application No. PCT/GB2013/000323 dated Oct. 14, 2013.

*Primary Examiner* — William Miller
(74) *Attorney, Agent, or Firm* — Renner, Otto, Boisselle & Sklar, LLP

(57) ABSTRACT

A door hinge comprises a body part for attaching to a door jamb and a door part for attaching to a door. A pivot coupling pivotally connects the door part to the body part about a displaceable pivot axis.

16 Claims, 8 Drawing Sheets

(56) References Cited

Figure 1A:
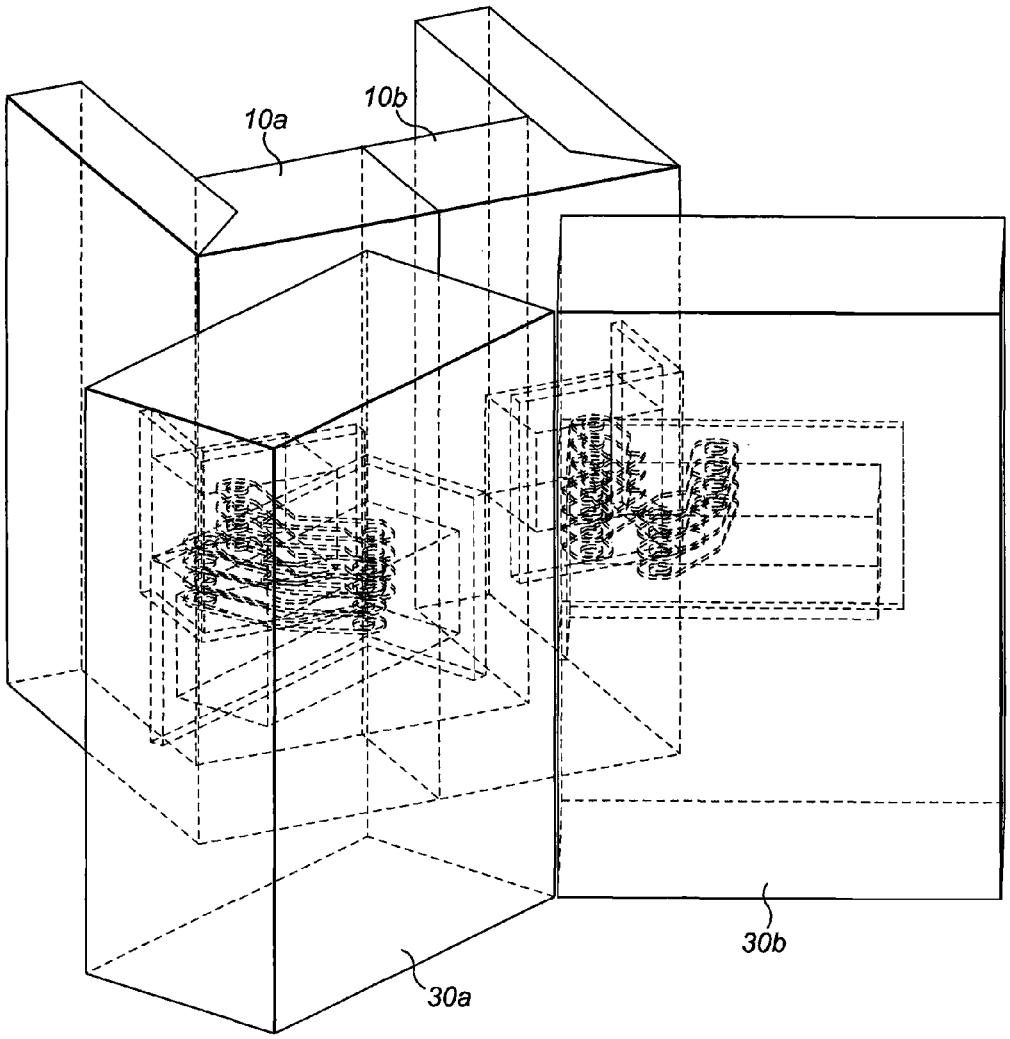

U.S. PATENT DOCUMENTS 3,001,224 A * 9/1961 Soss ..... E05D 3/16 16/276
3,209,390 A * 10/1965 Bassan ..... E05D 3/16 16/358
3,611,474 A * 10/1971 Meyer ..... E05D 3/18 16/358
3,673,635 A * 7/1972 Cencioni ..... E05D 3/06 16/358
3,744,086 A 7/1973 Salice et al.
3,864,786 A 2/1975 Salice
3,881,221 A * 5/1975 Schmidt ..... E05D 3/186 16/273
4,332,053 A * 6/1982 Salice ..... E05D 11/1021 16/235
4,499,631 A 2/1985 Lautenschläger
4,817,241 A * 4/1989 Koch ..... E05D 3/16 16/238
6,487,755 B1 * 12/2002 Caldari ..... E05D 3/186 16/287
8,650,713 B2 * 2/2014 Migliorini ..... E05D 3/16 16/298
8,850,661 B2 * 10/2014 Liermann ..... E05D 3/186 16/357
2004/0031125 A1 2/2004 Maurer
2011/0089801 A1 4/2011 Bonomie et al.

FOREIGN PATENT DOCUMENTS

DE 21 55 950 A1 8/1973
DE 23 53 043 A1 6/1974
DE 31 08 224 A1 9/1982
DE 4418238 A 11/1995
DE 20303262 U 4/2004
FR 2 205 089 A5 5/1974
GB 447734 5/1936
GB 1371862 10/1974
GB 1447293 A 8/1976
WO 2005/064106 7/2005

* cited by examiner

DOOR HINGE

This application is a national phase of International Application No. PCT/GB2013/000323 filed Jul. 24, 2013 and published in the English language.

The present invention relates to door hinges. The invention is particularly applicable to throw hinges for large or heavy doors.

A wide variety of throw hinges is available for doors fitted to cabinets, cupboards, wardrobes, and the like. One commonly used type is the European hinge, or "cup hinge", which comprises two parts: a cup part, which is attached to the interior of the cabinet side wall; and a mounting plate, which includes a pivot arm connected to the cup part and is attached to the inside of the cabinet door.

When the door is closed, the cup part and the mounting plate are at right angles to each other, and the pivot arm is received in the cup part. In the closed configuration, the hinge is hidden from view, thereby enhancing the aesthetic appearance of the cabinet. As the door is opened, the pivot arm moves out from the cup part to throw the door outwardly away from the cabinet. In the fully open configuration, the cup part and the mounting plate are inline with each other. That is, the opened door has been rotated outwardly through 90 degrees, thereby providing access to the inside of the cabinet.

However, the European hinge is not suitable for use with large or heavy doors because the narrow section of the pivot arm is subjected to great stress under high vertical loads, leading to distortion of the hinge which causes misalignment of the door with the cabinet and difficultly in opening and closing the door. If the loads are high enough then structural failure of the hinge may occur.

It is an aim of the present invention to provide an improved hinge for supporting large or heavy doors.

According to a first aspect of the present invention there is provided a door hinge, comprising: a body part for attaching to a door jamb, the body part including a jamb face; a door part for attaching to a door, the door part including a door face; and a pivot coupling which pivotally connects the door part to the body part about a displaceable pivot axis, wherein the door face faces in a first direction towards the jamb face when the hinge is in a closed configuration and in a second direction when the hinge is in an open configuration.

An arrangement wherein the door face faces towards the jamb face when the hinge is in a closed configuration means that the body part of the hinge can be fitted to the front, rather than to the side, of the carcass of the cabinet (or cupboard, wardrobe, or the like). This is particularly advantageous because the hinge does not intrude into the interior space of the cabinet, thereby providing improved storage capacity and access.

According to a second aspect of the present invention there is provided a door hinge, comprising: a body part for attaching to a door jamb, the body part including a jamb face; a door part for attaching to a door; and a pivot coupling which pivotally connects the door part to the body part about a displaceable pivot axis, wherein the displaceable pivot axis is displaced from a first location when the hinge is in a closed configuration to a second location along and away from the jamb face when the hinge is in an open configuration.

Movement of the displaceable pivot axis along and away from the jamb face advantageously enables a thick door, to which the hinge may be attached, to be thrown outwardly of a cabinet door jamb, from a closed position to an open position.

Embodiments of the present invention will now be described by way of example, with reference to the accompanying figures in which:

FIG. 1*a* shows a perspective view of two door hinges according to the invention, wherein the hinges are installed in respective doors and door jambs of a cabinet.

Figure 1B:
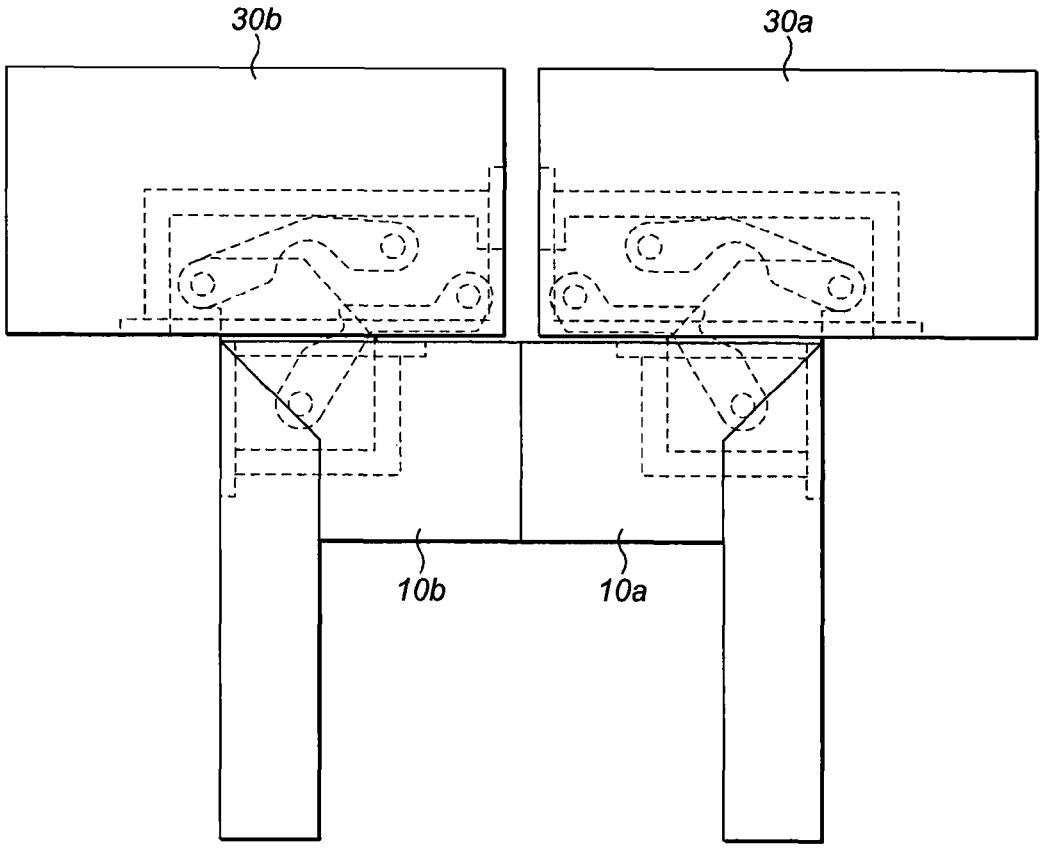

FIG. 1*b* shows a plan view of the installed hinges of FIG. 1*a*, wherein the hinges are in a closed configuration.

Figure 1C:
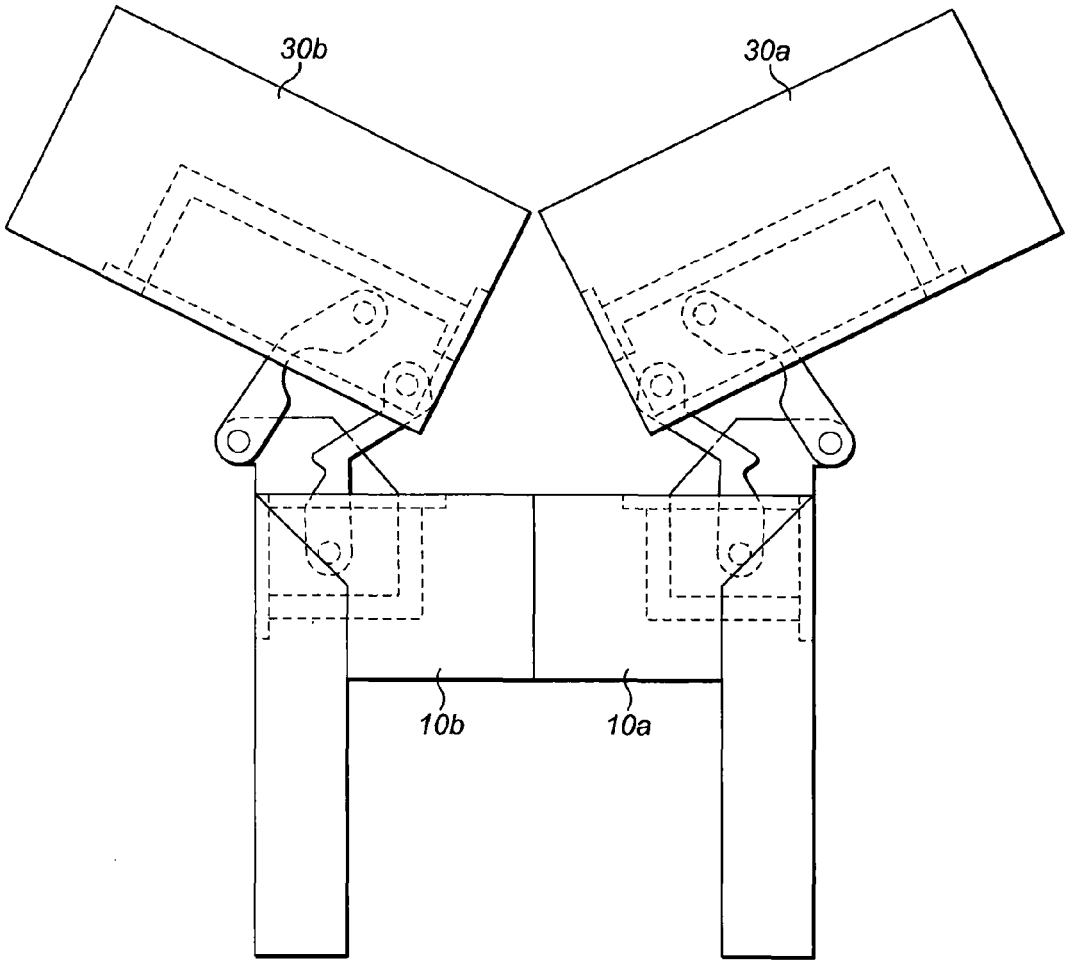

FIG. 1*c* shows a plan view of the installed hinges of FIG. 1*a*, wherein the hinges are in a partly open configuration.

Figure 1D:
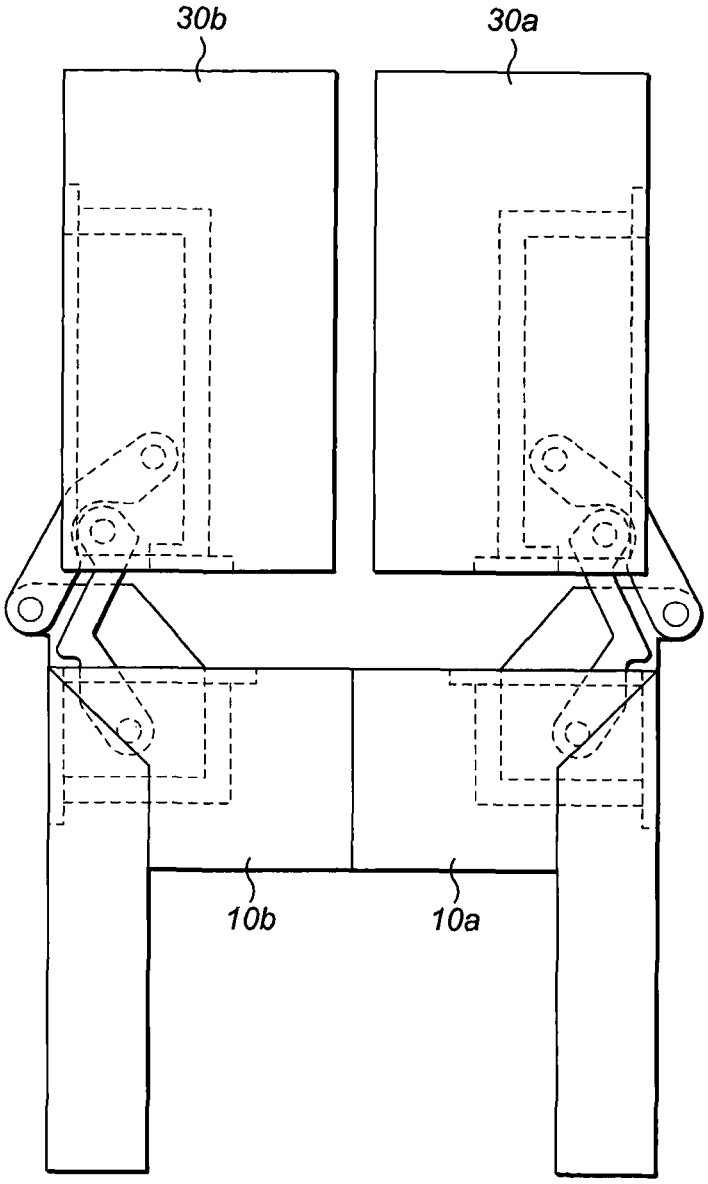

FIG. 1*d* shows a plan view of the installed hinges of FIG. 1*a*, wherein the hinges are in a fully open configuration.

Figure 2A:
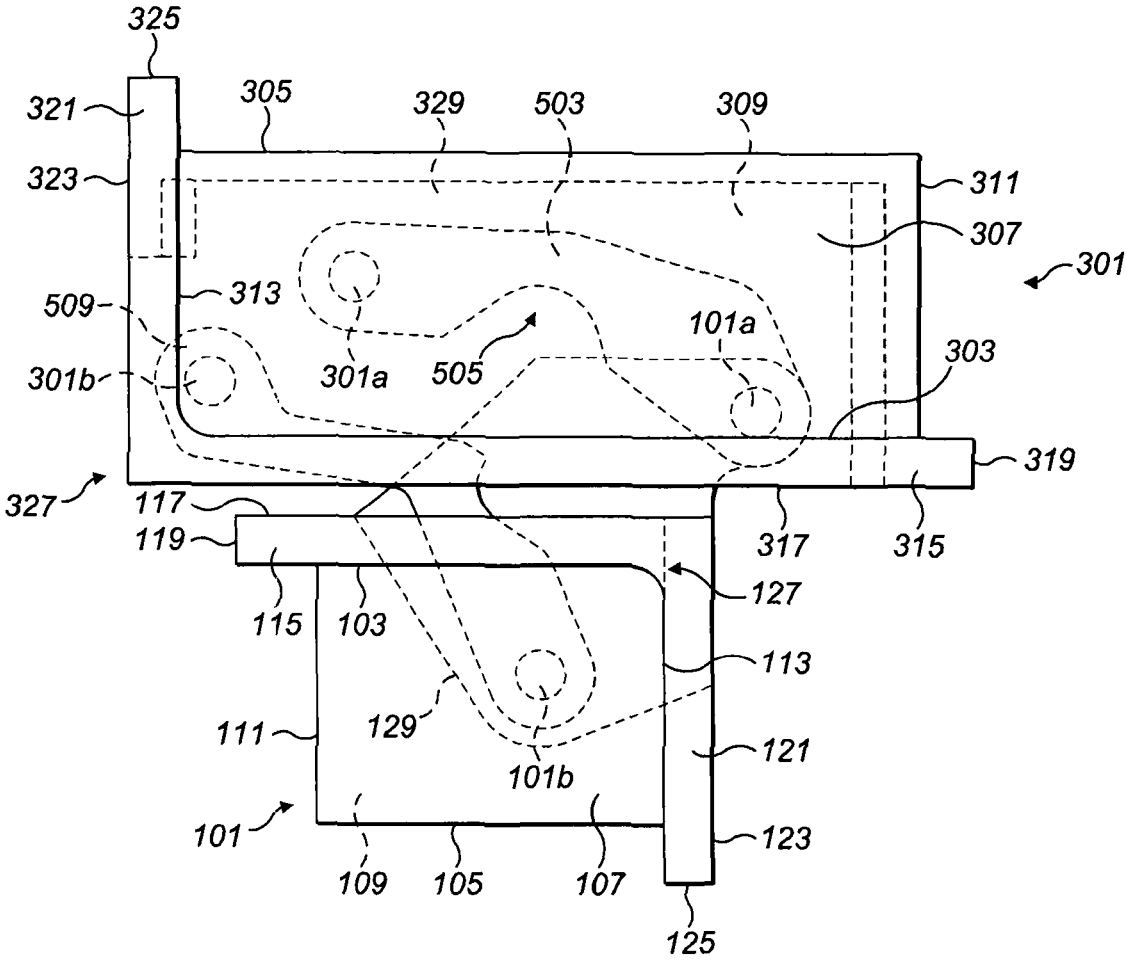

FIG. 2*a* shows a plan view of a hinge according to the invention, wherein the hinge is in a closed configuration.

Figure 2B:
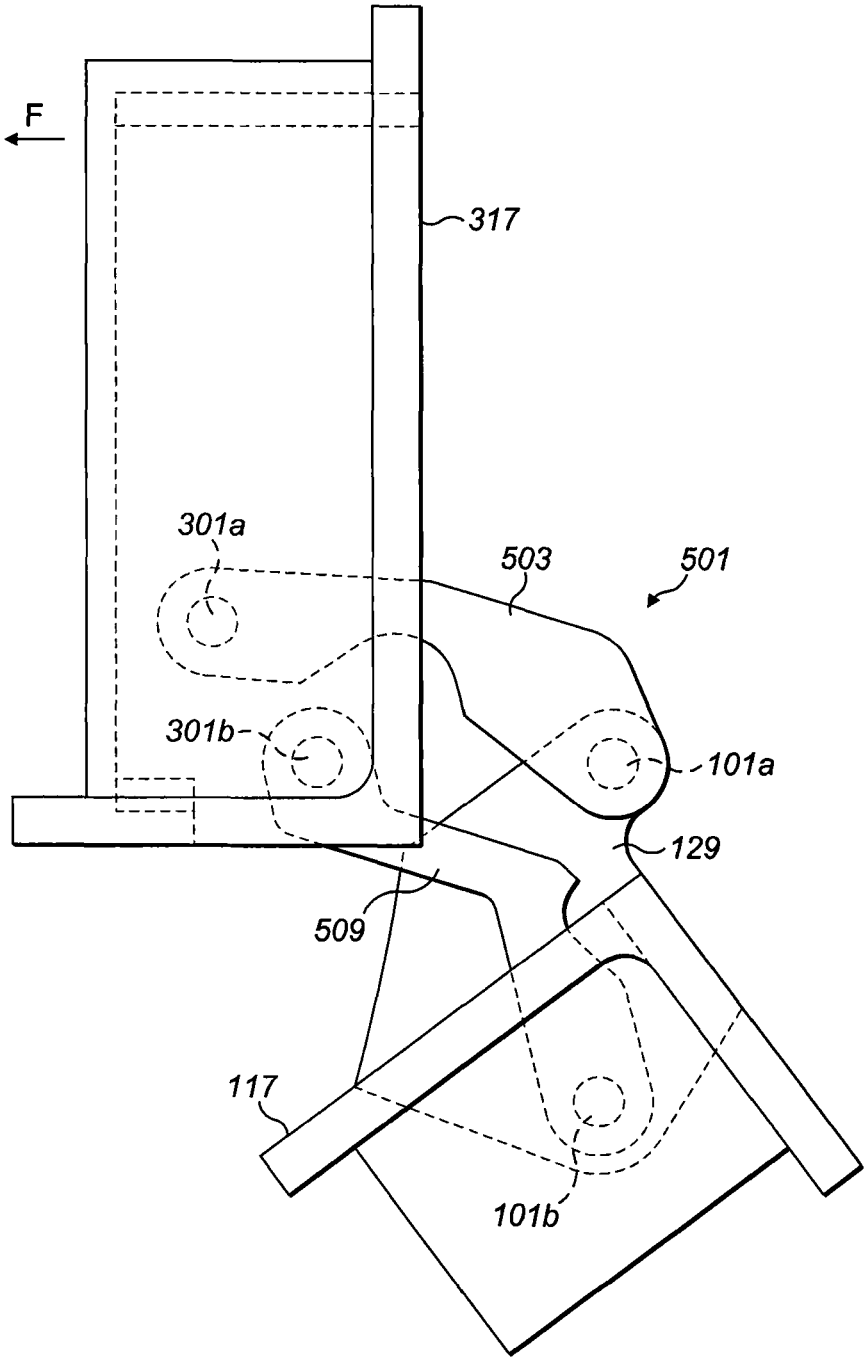

FIG. 2*b* shows a plan view of the hinge of FIG. 2*a*, wherein the hinge is in a partly open configuration.

Figure 2C:
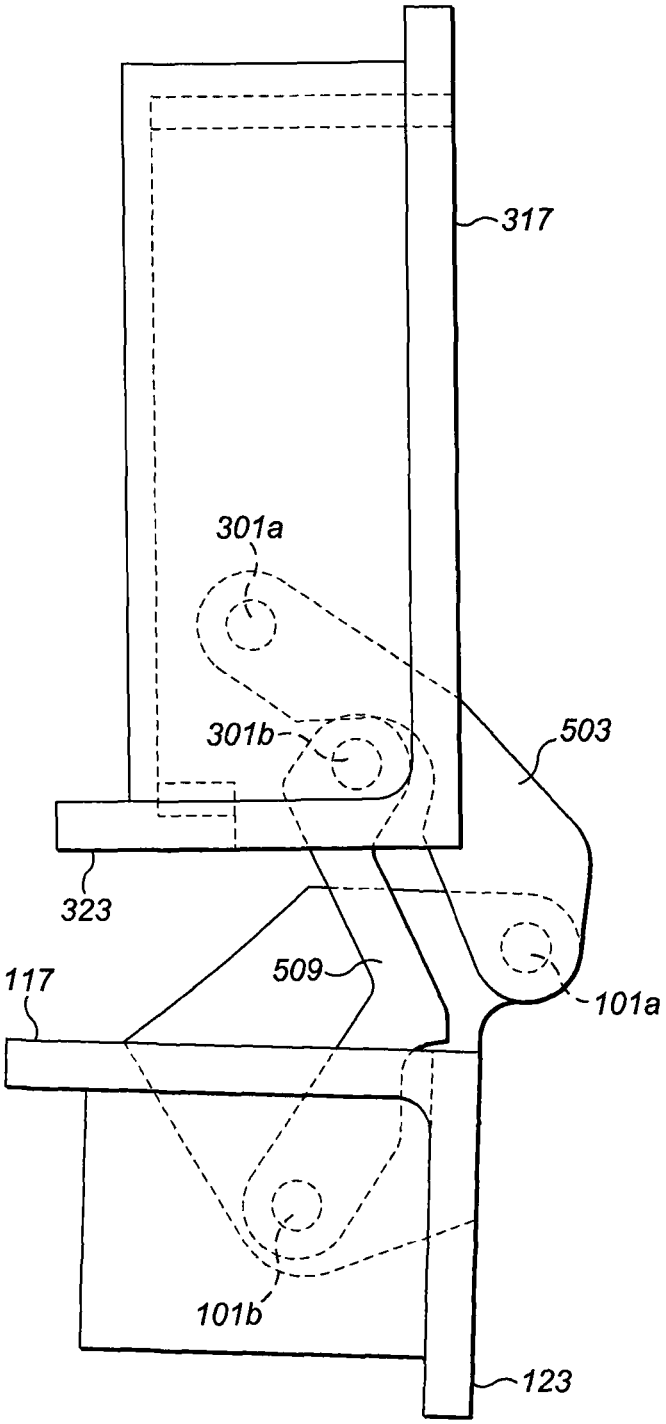

FIG. 2*c* shows a plan view of the hinge of FIG. 2*a*, wherein the hinge is in a fully open configuration.

Figure 3:
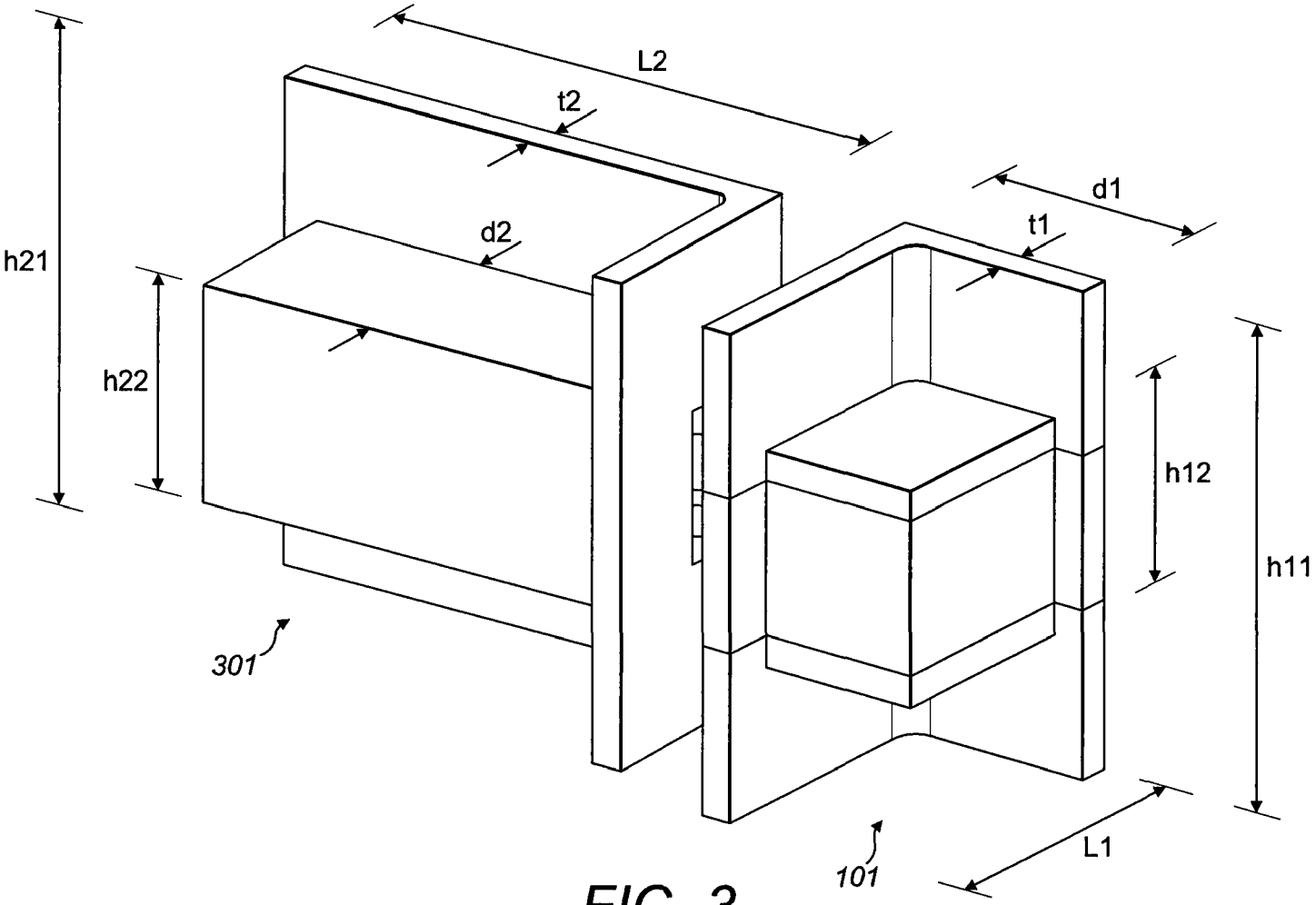

FIG. 3 shows an isometric view of the hinge of FIG. 2*a*, wherein the hinge is in a fully open configuration.

Referring to FIGS. 1*a* to 1*d*, a pair of throw hinges are installed in a respective pair of door jambs 10*a*, 10*b* and doors 30*a*, 30*b* of a cabinet, and are operable to move the doors from a closed position to an open position. In this embodiment, the hinges are mortised in the door jambs 10*a*, 10*b* and doors 30*a*, 30*b*.

Referring now to FIG. 2*a*, a door hinge of the type shown in FIGS. 1*a* to 1*d* comprises a jamb body part 101 for attaching to a door jamb, a door part 301 for attaching to a door, and a pivot coupling 501 which pivotally connects the door part 301 to the jamb body part 101.

The jamb body part 101 comprises a cuboid, or block-shaped, member comprising a front side 103, a rear side 105, a top 107, a bottom 109, a left end 111, and a right end 113. A first flange wall 115 extends from the front side 103 to form a jamb front, or major, face 117 of the jamb body part 101. In this embodiment, the first flange wall 115 extends leftward beyond the left end 111 to form an extended left edge 119 of the jamb front face 117. Also in this embodiment, a second flange wall 121 extends from the right end 113 to form a jamb end face 123 of the jamb body part 101. In this embodiment, the second flange wall 121 extends rearward beyond the rear side 105 to form an extended rear edge 125 of the jamb end face 123. The first and second flange walls 115, 121 intercept to form a jamb body part corner 127 between the jamb front face 117 and the jamb end face 123.

The cuboid shape of the jamb body part 101 is suitable to be mortised into a door jamb to provide a strong and robust anchor to the hinge. In this embodiment, the first and second flange walls 115, 121 include holes (not shown) for receiving screws or the like for attaching the jamb body part 101 to the door jamb.

In this embodiment, the jamb body part 101 further comprises a support member 129 which projects outwardly from the front side 103 and comprises upper and lower surfaces which are coplanar with the top and bottom sides 107, 109. Above and below the support member 129, a pair of open slots 131 extend into the jamb body part 101 from the front side 103.

The door part 301 comprises a cuboid, or block-shaped, member comprising a front side 303, a rear side 305, a top 307, a bottom 309, a right end 311, and a left end 313. A first flange wall 315 extends from the front side 303 to form a door front, or major, face 317 of the door part 301. In this embodiment, the first flange wall 315 extends rightward beyond the right end 311 to form an extended right edge 319 of the door front face 317. Also in this embodiment, a second flange wall 321 extends from the left end 313 to form a door end face 323 of the door part 301. In this embodiment, the second flange wall 321 extends rearward beyond the rear side 305 to form an extended rear edge 325 of the door end face 323. The first and second flange walls 315, 321 intercept to form a door part corner 327 between the door front face 317 and the door end face 323.

The cuboid shape of the door part 301 is suitable to be mortised into a door to provide a strong and robust support to the door. In this embodiment, the first and second flange walls 315, 321 include holes (not shown) for receiving screws or the like for attaching the door part 301 to the door.

The door part 301 is open at the front side 303 and left end 313 to define a channel 329 which extends rightward along the door part 301 to approximately 90 percent of the way to the right end 311, and rearward across the door part 301 to approximately 75 percent of the way to the rear side 305. The channel 329 is configured to receive the pivot coupling 501 and the support member 129 when the hinge is in the closed position.

The pivot coupling 501 comprises a first arm 503 which, in this embodiment, includes a recess 505. Also in this embodiment, one end of the first arm 503 comprises a pair of lugs 507 which are disposed spaced apart by the support member 129 in substantially parallel relationship and pivotally connected to a distal end of the support member 129 by a pin extending therethrough, thereby providing a first jamb body part fixed pivot axis 101*a*. That is, the pivotal connection between the first arm 503 and the support member 129 is fixed in space with respect to the jamb body part 101. In this embodiment, the pin is fixed with respect to the first arm 503 and is rotatable with respect to the support member 129.

The other end of the first arm 503 is pivotally connected between the top and bottom sides 307, 309 of the door part 301 by a pin extending therethrough, thereby providing a first door part displaceable pivot axis 301*a*. That is, the pivotal connection between the first arm 503 and the door part 301 is movable in space with respect to the jamb body part 101. Furthermore, the door part 301 is free to rotate about the first door part displaceable pivot axis 301*a* with respect to the first arm 503. In this embodiment, the pivotal connection is located at about 30 percent of the way from the left end 313 to the right end 311, and about 60 percent of the way from the front side 303 to the rear side 305, of the door part 301. Also in this embodiment, the pin is fixed with respect to the first arm 503 and the door part 301.

In this embodiment, the pivot coupling further comprises a second arm 509 which comprises two substantially identical members, disposed spaced apart by the support member 129 in substantially parallel relationship. At one end of the second arm 509, the elongate members extend into the slots 131 of the jamb body part 101 wherein they are pivotally connected to a proximate end of the support member 129 by a pin extending therethrough, thereby providing a second jamb body part fixed pivot axis 101*b*. That is, the pivotal connection between the second arm 509 and the jamb body part 101 is fixed in space with respect to the jamb body part 101. In this embodiment, the pin also extends through the top and bottom sides 107, 109 of the jamb body part 101. In this embodiment, the pivotal connection is located at about 70 percent of the way from the left end 111 to the right end 113, and about 50 percent of the way from the front side 103 to the rear side 105, of the jamb body part 101. Also in this embodiment, the pin is fixed with respect to the jamb part body 101 and the second arm 509.

The other end of the second arm 509 is pivotally connected between the top and bottom sides 307, 309 of the door part 301 by a pin extending therethrough, thereby providing a second door part displaceable pivot axis 301*b*. That is, the pivotal connection between the second arm 509 and the door part 301 is movable in space with respect to the jamb body part 101. In this embodiment, the pivotal connection is located at about 5 percent of the way from the left end 313 to the right end 311, and about 10 percent of the way from the front side 303 to the rear side 305, of the door part 301, that is, near the door part corner 327. Also in this embodiment, the pin is fixed with respect to the second arm 509 and the door part 301.

In this embodiment, the jamb body part 101, the door part 301, and the pivot coupling 501, are formed of stainless steel. Also in this embodiment, the jamb body part 101 and the door part 301 are of unitary construction.

In the closed configuration shown in FIG. 2*a*, the door front face 317 is opposed to and parallel with the jamb front face 117. The first door part displaceable pivot axis 301*a* is at a first location which, in this embodiment, is within the projected length of the jamb front face 117. The second door part displaceable pivot axis 301*b* is at a first location which, in this embodiment, is beyond the projected length of the jamb front face 117. The pivot coupling 501 and the projecting portion of the support member 129 are received in the channel 129.

Turning now to aspects related to the operation of the hinge, and referring to FIG. 2*b*, a force F which is applied to open the door, for example by an operative pulling a door handle, is transmitted to the pivotal connection between the first arm 503 and the door part 301, thereby initiating rotation of the first arm 503 about the first jamb body part fixed pivot axis 101*a*. As the pulling force F continues to be applied, the first door part displaceable pivot axis 301*a* describes a path of travel along and away from the jamb front face 117, thereby throwing the door part 301 outwardly away from the jamb body part 101 into an open configuration.

At the same time, the applied pulling force F is also transmitted, in this embodiment, to the pivotal connection between the second arm 509 and the door part 301, thereby causing rotation of the second arm 509 about the second jamb body part fixed pivot axis 101*b*. As the pulling force F continues, the second door part displaceable pivot axis 301*b* describes a path of travel along and away from the jamb front face 117, thereby guiding the door part 301 toward a fully open configuration. The second arm 509 advantageously provides improved control of the path of the door part 301 by guiding the door part end face 323 into opposition with the jamb front face 117, thereby bringing the door front face 317 neatly inline with the jamb end face 123 in a fully open configuration.

Referring now to FIG. 2*c*, when the hinge is in the fully open configuration, the first door part displaceable pivot axis 301*a* is at a second location which is along and away from the jamb front face 117. In this embodiment, the second location is within the projected length of the jamb front face 117. Furthermore, the second door part displaceable pivot axis 301*b* is at a second location which is along and away from the jamb front face 117. In this embodiment, the second location is within the projected length of the jamb front face 117. In this embodiment, the second door part displaceable pivot axis 301*b* is moved further along the jamb front face 117 than is the first door part displaceable pivot axis 301*a*.

In the fully open configuration, the door front face 317 is orthogonal to the jamb front face 117. In this embodiment, the door front face 317 is also inline with the jamb end face 123. Furthermore, the door part end face 323 is opposed to the jamb front face 117. Also, a portion of the second arm 509 is received by the recess 505 of the first arm 503.

In one embodiment, the hinge has the following approximate dimensions: h11=53 mm, h12=33 mm, I1=47 mm, d1=35 mm, t1=3 mm, h21=53 mm, h22=33 mm, I2=80 mm, d2=26 mm, t2=3 mm, as illustrated in FIG. 3. By way of example, this embodiment would be suitable for supporting a door which is about 4 m high and 54 mm thick.

Thus, the hinge of the present invention provides a strong and robust support for large or heavy doors. Furthermore, unlike the prior art hinge discussed above, the hinge advantageously does not intrude into the interior space of the cabinet because the jamb front face 117 and the door front face 317 are arranged in parallel, rather than orthogonal, relationship when the hinge is in a closed configuration.

In an embodiment of the invention, the second arm 509 is omitted.

In an embodiment of the invention, the pivot coupling 501 includes friction-reducing members, for example nylon bushes.

In an embodiment of the invention, any or all of the jamb body part 101, the door part 301, and the pivot coupling 501 are formed of stainless steel, aluminium, brass, or plastics.

It will be understood that the present invention has been described in relation to its preferred embodiments and may be modified in many different ways without departing from the scope of the invention as defined by the accompanying claims.

The invention claimed is:

1. A door hinge for supporting a door to a door jamb and being operable between a closed configuration and a fully open configuration, the door hinge comprising:

a mortised body part for attaching to the door jamb, wherein the body part includes a first jamb face having a lateral extent and a second jamb face which is generally orthogonal to the first jamb face;

a mortised door part for attaching to the door, the door part including a door front face;

a pivot coupling which pivotally connects the door part to the body part, wherein the pivot coupling comprises:

a first arm which is coupled to the body part about a first fixed pivot axis and to the door part about a first displaceable pivot axis, the first fixed pivot axis being located outwardly of the first jamb face, and the first displaceable pivot axis being displaced from a first location when the hinge is in the closed configuration to a second location along and away from the first jamb face in relation to the lateral extent of the first jamb face when the hinge is in the fully open configuration; and a second arm which is coupled to the body part about a second fixed pivot axis and to the door part about a second displaceable pivot axis, the second fixed pivot axis being located inside the body part, and the second displaceable pivot axis being displaced from a first location when the hinge is in the closed configuration to a second location along and away from the first jamb face in relation to the lateral extent of the first jamb face when the hinge is in the fully open configuration;

wherein the door front face is generally parallel to the first jamb face when the hinge is in the closed configuration and generally orthogonal to the first jamb face when the hinge is in the fully open configuration.

2. A door hinge according to claim 1, wherein the door front face is juxtaposed outwardly and extends beyond the lateral extent of the first jamb face when the hinge is in the closed configuration.

3. A door hinge according to claim 1, wherein the first displaceable pivot axis is displaced within the lateral extent of the first jamb face when the hinge is moved between the closed and fully open configurations.

4. A door hinge according to claim 1, wherein the first fixed pivot axis is located outwardly of the second jamb face.

5. A door hinge according to claim 1, wherein the second displaceable pivot axis is within the lateral extent of the first jamb face when the hinge is in the fully open configuration.

6. A door hinge according to claim 1, wherein the second displaceable pivot axis is located beyond the lateral extent of the first jamb face when the hinge is in the closed configuration.

7. A door hinge according to claim 1, wherein the second displaceable pivot axis is displaced further along the lateral extent of the first jamb face than is the first displaceable pivot axis when the hinge is moved from the closed configuration to the fully open configuration.

8. A door hinge according to claim 1, wherein the first displaceable pivot axis is located outwardly of the second displaceable pivot axis from the first jamb face when the hinge is in the fully open and closed configurations.

9. A door hinge according to claim 1, wherein the first arm includes a recess for partially receiving the second arm when the hinge is in the fully open configuration.

10. A door hinge according to claim 1, wherein the door part includes a channel for receiving the pivot coupling when the hinge is in the closed configuration.

11. A door hinge according to claim 1, wherein the door front face is in line with the second jamb face when the hinge is in the fully open configuration.

12. A door hinge according to claim 1, wherein the door part includes a door end face which is generally orthogonal to the door front face, and the door end face is opposed to the first jamb face when the hinge is in the fully open configuration.

13. A door hinge according to claim 1, wherein the second displaceable pivot axis is located outwardly of the second fixed pivot axis from the second jamb face in the closed configuration and inwardly of the second fixed pivot axis from the second jamb face in the fully open configuration.

14. A door hinge according to claim 1, formed of metal.

15. A door hinge according to claim 1, formed of plastics.

16. The door in combination with the door hinge according to claim 1.

* * * * *